United States Patent [19]

Friedlaender et al.

[11] Patent Number: 4,526,681

[45] Date of Patent: Jul. 2, 1985

[54] MAGNETIC SEPARATION METHOD UTILIZING A COLLOID OF MAGNETIC PARTICLES

[75] Inventors: Fritz J. Friedlaender, West Lafayette, Ind.; Makoto Takayasu, Somerville, Mass.; Jiann-Yang Hwang, Lafayette, Ind.; Leon Petrakis, Pittsburgh, Pa.

[73] Assignee: Purdue Research Foundation, West Lafayette, Ind.

[21] Appl. No.: 547,055

[22] Filed: Oct. 31, 1983

[51] Int. Cl.[3] ..... B03C 1/00

[52] U.S. Cl. ..... 209/214; 209/232; 209/38

[58] Field of Search ..... 209/1, 17, 39, 213-215, 209/232, 38, 223 R

[56] References Cited

U.S. PATENT DOCUMENTS

| | | | |
|---|---|---|---|
| 933,717 | 9/1909 | Lockwood et al. . | |
| 2,072,907 | 3/1937 | Rowand | 209/214 |
| 3,466,154 | 9/1969 | Hori et al. | 23/317 |
| 3,483,968 | 12/1969 | Kaiser | 209/1 |
| 3,483,969 | 12/1969 | Rosenswieg | 209/1 |
| 3,703,958 | 11/1972 | Kolm | 210/65 |
| 3,923,651 | 12/1975 | Weiss et al. | 210/21 |
| 3,926,789 | 12/1975 | Shubert | 209/8 |
| 3,929,627 | 12/1975 | Frangiskos et al. | 209/9 |
| 4,062,765 | 12/1977 | Fay et al. | 209/1 |
| 4,085,037 | 4/1978 | Quets et al. | 209/1 |
| 4,087,004 | 5/1978 | Nott et al. | 209/9 |
| 4,089,779 | 5/1978 | Neal | 210/425 |
| 4,102,780 | 7/1978 | Sun et al. | 209/39 |
| 4,108,767 | 8/1978 | Cooper | 210/43 |
| 4,113,608 | 9/1978 | Kazama et al. | 209/1 |
| 4,125,460 | 11/1978 | Nott et al. | 209/8 |
| 4,144,163 | 3/1979 | Kolm | 209/12 |
| 4,187,170 | 2/1980 | Westcott et al. | 209/1 |
| 4,214,981 | 7/1980 | Giddings | 209/155 |
| 4,230,685 | 10/1980 | Senyei et al. | 424/12 |
| 4,235,710 | 11/1980 | Sun | 209/213 |
| 4,309,290 | 1/1982 | Heitkamp | 210/695 |

FOREIGN PATENT DOCUMENTS

| | | | |
|---|---|---|---|
| 2444578 | 1/1976 | Fed. Rep. of Germany | 209/232 |
| 159292 | 3/1982 | German Democratic Rep. | 209/232 |
| 558707 | 3/1975 | U.S.S.R. | 209/1 |
| 649465 | 2/1979 | U.S.S.R. | 209/1 |

OTHER PUBLICATIONS

Y. Zimmels & I. Yaniv, "Characterization of Magnetic Forces by Means of Suspended Particles in Paramagnetic Solutions," IEEE Trans. Magn., vol. Mag-12, No. 4, 359-68, Jul. 1976.

S. Khalafalla, "Magnetic Separation of the Second Kind: Magnetogravimetric, Magnetohydrostatic, and Magnetohydrodynamic Separations," IEEE Trans. Magn., vol. Mag-12, No. 5, 455-62, Sep. 1976.

D. Kelland, H. Kolm, C. deLatour, E. Maxwell, & J. Oberteuffer, Superconducting Machines and Devices, S. Foner & B. Schwartz (ed.), Chapter 10, Plenum Press, N.Y. (1974).

D. Kelland, "High Gradient Magnetic Separation Applied to Mineral Beneficiation," IEEE Trans. Magn., vol. Mag-9, No. 3, 307-10, Sep. 1973.

F. Luborsky & B. Drummond, "High Gradient Magnetic Separation: Theory Versus Experiment," IEEE Trans. Magn., vol. Mag-11, No. 6, 1696-1700, Nov. 1975.

(List continued on next page.)

*Primary Examiner*—Frank W. Lutter
*Assistant Examiner*—W. Bond
*Attorney, Agent, or Firm*—Barnes & Thornburg

[57] ABSTRACT

A method of magnetically separating particles having different magnetic susceptibilities. A magnetic field is established in a colloidal suspension of magnetic particles which distribute to form a magnetic susceptibility gradient. The particles to be separated are introduced into the colloidal suspension. The introduced particles migrate along the magnetic susceptibility gradient to different regions having approximately the same magnetic susceptibilities as the introduced particles.

14 Claims, 13 Drawing Figures

OTHER PUBLICATIONS

F. Luborsky & B. Drummond, "Buildup of Particles on Fibers in a High-Field High-Gradient Separator," IEEE Trans. Magn., vol. Mag-12, No. 5, 463-65, Sep. 1976.

J. Ji-Nong Sun, "Magnetic Barrier-A New Concept in Magnetic Separation," IEEE Trans. Magn., vol. Mag-12, No. 5, 483-85, Sep. 1976.

C. Cowen & F. Friedlaender, "Single Wire Model of High Gradient Magnetic Separation Processes III," IEEE Trans. Magn., vol. Mag-13, No. 5, 1483-85, Sep. 1977.

F. Friedlaender, M. Trakayasu, T. Nakano, "Diamagnetic Capture in Single Wire HGMS," IEEE Trans. Magn., vol. Mag-14, No. 6, 1526-28, Nov. 1979.

F. Friedlaender & M. Takayasu, "A Study of the Mechanisms of Particle Buildup on Single Ferromagnetic Wires and Spheres," IEEE Trans. Magn., vol. Mag-18, No. 3, May 1982.

F. Friedlaender et al., U.S. patent application Ser. No. 321,411, filed Nov. 16, 1981.

MAGNETIC SEPARATION METHOD UTILIZING A COLLOID OF MAGNETIC PARTICLES

The research which resulted in the present invention was funded in part under a contract with the Department of the Interior and a grant from the National Science Foundation.

This invention relates to the separation of particles into mono-fractions, and more particularly to the magnetic separation of a mixture of particles having different magnetic susceptibilities into mono-fractions.

Magnetic separation techniques have been known for many years. S. E. Khalafalla, *Magnetic Separation of the Second Kind: Magnetogravimetric, Magnetohydrostatic, and Magnetohydrodynamic Separations, IEEE Transactions on Magnetics,* Vol. MAG-12, No. 5 (September 1976), discloses techniques of separating essentially non-magnetic particles by establishing a magnetic field gradient through a magnetic fluid surrounding the non-magnetic particles. The effective density of the magnetic fluid is varied by the magnetic field gradient permitting the effective buoyancy force acting on the suspended particles to be varied over a large range. In these techniques, the density of the material to be separated is a key factor determining the separation in that these techniques achieve separation by diverting particles along trajectories based upon their densities as they settle through the magnetic field.

Another well-known technique of magnetic separation is high-gradient magnetic separation. With respect to high-gradient magnetic separation, the following are referenced: (1) D. R. Kelland et al, *Superconducting Machines and Devices,* S. Foner and B. B. Schwartz (ed), Chapter 10, Plenum Press, New York, 1974; (2) M. E. Arellano, G. Zambrana and C. Soux, *Proc. International Tin Symposium,* La Paz, Bolivia, November 1977; (3) D. R. Kelland, *IEEE Transactions on Magnetics,* Vol. MAG-9, No. 3, pp. 307–310, September 1973; (4) F. E. Luborsky and B. J. Drummond, *IEEE Trans. Magn.,* MAG-11, p. 1696, 1976; (5) E. E. Luborsky and B. J. Drummond, *IEEE Trans. Magn.* MAG-12, p. 474, 1976; (6) C. Cowen and F. J. Friedlaender, *IEEE Trans. Magn.* MAG-13, p. 1483, 1977; and (7) *IEEE Trans. Magn.,* Vol. MAG-12, No. 5, 1976).

In certain applications involving the separation of a variety of materials ranging from ferromagnetic to diamagnetic, such as the beneficiation of minerals, a magnetic separation technique with a selectivity covering a wide range of magnetic susceptibilities is desirable. To date, there has not been an adequate method for such a purpose. Further, the selectivity of magnetic separation methods in general has not been satisfactory. The separation factor depends on the particle size, the particle density, the particle shape, etc., as well as the magnetic susceptibility.

The instant invention provides an improved method and apparatus for magnetically separating particles having different magnetic susceptibilities. A magnetic field gradient is established through a fluid which is made up of a colloidal suspension of magnetic particles. The particle concentration of the colloidally suspended magnetic particles therefore varies spatially along the magnetic field gradient, creating a magnetic susceptibility gradient through the fluid. In the region of the magnetic susceptibility gradient, the particles to be separated migrate toward equilibrium positions in the fluid on the basis of their magnetic susceptibilities relative to the local magnetic susceptibility of the colloidal solution.

According to the invention, a method and apparatus are provided for achieving "pure" magnetic separation of particles according to their magnetic susceptibilities independently of the densities, sizes, and shapes of the various particles.

The invention may best be understood by referring to the following description and accompanying drawings which illustrate the invention. In the drawings.

Figure 1:
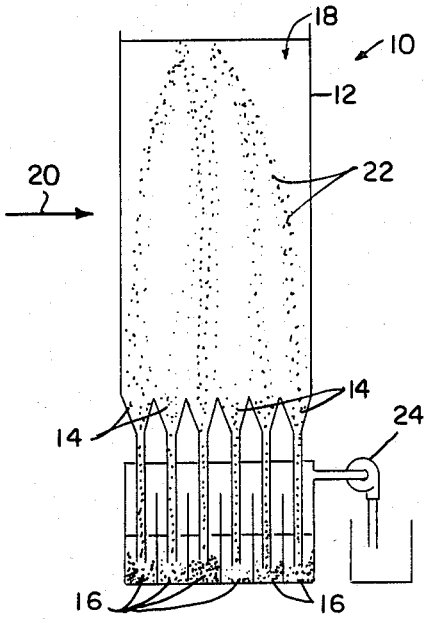
FIG. 1 is a schematic illustration of an embodiment of the instant invention.

A submicron particle in a liquid or a gas can move randomly at all times, when a particle is much smaller than 1 $\mu$m in size. This phenomenon is well known and called "Brownian motion." A colloid of submicron particles of ferromagnetic, ferrimagnetic, or paramagnetic materials provides a magnetic solution analogous to a paramagnetic salt solution. The magnetic susceptibility of a colloid made up of sufficiently small particles may be expressed by $$\chi_f=c(\chi_{fp}-\chi_{fs})+\chi_{fs} \quad (1)$$

where $\chi_f$ is magnetic susceptibility of a colloidal fluid, $\chi_{fp}$ and $\chi_{fs}$ are the magnetic susceptibilities of the particles and the solvent forming a colloid, respectively, and c is the volume concentration of particles in the fluid.

The magnetic moment of a paramagnetic salt in solution is subject to physical limitations with the result that large effective susceptibilities cannot be obtained. A colloidal solution of magnetic submicron particles can have a much larger magnetic susceptibility, and also can provide any value of susceptibility within a wide range by adjustment of the concentration of paramagnetic and ferromagnetic particles.

Since the colloidal solution consists of magnetic particles with a certain volume which is much larger than that of ions in a paramagnetic salt solution, the particles are forced to move gradually along the magnetic gradient in a high-gradient magnetic field. The equilibrium state of the distribution of the particles is established by a balance between the drift due to the magnetic force and the diffusion due to a gradient of particle concentration. The distribution of the particle volume concentration c in a magnetic field is given (from the diffusion equation for the steady state) by $$c = c_o \exp\left\{ \frac{2\pi(\chi_{fp} - \chi_{fs})\mu_o d^3}{3kT} (H_x^2 - H_o^2) \right\} \tag{2}$$

where $H_x$ is the magnetic field as a function of a position x, $H_o$ and $c_o$ are the magnetic field and the particle concentration respectively for a given position $x = x_o$, T is the absolute temperature, $\chi_{fp}$ and $\chi_{fs}$ are susceptibility values at the temperature T, d is the particle radius, $\mu_o$ is the permeability of vacuum, and k is the Boltzmann constant.

From Equations (1) and (2), the magnetic susceptibility $\chi_f$ of a colloidal solution in a magnetic field gradient can be written as $$\chi_f = (\chi_{fp} - \chi_{fs})\, c_o \exp\left\{ \frac{2\pi(\chi_{fp} - \chi_{fs})\mu_o d^3}{3kT} (H_x^2 - H_o^2) \right\} + \chi_{fs} \tag{3}$$

Since $\chi_f$ is an exponential function of the magnetic field $H_x$ (Equation (3)), a very wide range of values of magnetic susceptibility $\chi_f$ as a function of x can be obtained when a magnetic field gradient is applied. This magnetic susceptibility gradient makes possible a new method of magnetic separation, to be described in the following.

The magnetic force experienced by a particle (to be separated) of a volume $V_p$ can be written as $$F_m = (\tfrac{1}{2})\mu_o V_p \{(\chi_p - \chi_f)\, \vec{H}^2\} \tag{4}$$

where $\chi_p$ is the susceptibility of the particles and H is the magnetic field. On the other hand, the gravitational force (the Archimedes buoyancy force) on the particle is given by $$\vec{F}_g = -g(\rho_p - \rho_f)\, V_p \hat{y} \tag{5}$$

where $\rho_p$ and $\rho_f$ are the densities of the particle and the colloidal fluid respectively, g is the gravitational constant, and $\hat{y}$ is the unit vector in the vertical direction. The hydrodynamic drag force in the Stokes region is given by $$\vec{F}_d = -6\pi\eta b \vec{v}_p \tag{6}$$

where $\eta$ is the viscosity of the fluid, b is the radius of the particle, and $\vec{v}_p$ is the velocity of the particle. The particle motion is given by $$\vec{F}_m + \vec{F}_g + \vec{F}_d = 0 \tag{7}$$

when the inertial force is negligible.

If the magnetic gradient $\nabla\vec{H}$ is in the horizontal direction (the x-direction) and the gravitationial force is in the vertical direction (the y-direction), the equations of the particle motion are written in cartesian coordinate form Equation (7) by $$\frac{dx}{dt} = \frac{\mu_o b^2}{g\eta}\left\{ (\chi_p - \chi_f)\frac{dH_x^2}{dx} - H_x^2 \frac{d\chi_f}{dx} \right\} \tag{8}$$

$$\frac{dy}{dt} = -\frac{2(\rho_p - \rho_f)gb^2}{g\eta} \tag{9}$$

The velocity dy/dt given by Equation (9) is the settling velocity. During gravitational settling, the particles move also in the horizontal direction (x-axis) due to the magnetic force with the velocity given by Equation (8). The resulting horizontal displacement is such that the particle will be in equilibrium at the position when $$\chi_p = \frac{\chi_f - \left(\frac{H_o}{H_x}\right)^2 \chi_{fo}}{1 - \left(\frac{H_o}{H_x}\right)^2} \tag{10}$$

for dx/dt=0 (steady state condition), here $\chi_{fo}$ is the value of the colloidal fluid susceptibility $\chi_f$ at $H_x = H_o$.

This method makes possible a "pure" magnetic separation, that is, a separation which depends only on the magnetic susceptibility of the particle and does not depend on other factors such as density, size, and shape. Since the values of magnetic susceptibility $\chi_f$ can range over several orders of magnitude as discussed above, particles made of different materials ranging from ferromagnetic to diamagnetic can be separated by this technique.

Referring now to FIG. 1, an apparatus constructed in accordance with the instant invention is illustrated schematically. A magnetic separation system 10 has a container 12 having a plurality of outlets 14 generally dispersed laterally across the bottom of the container 12. The magnetic separation system 10 further has a plurality of collection reservoirs 16 located generally beneath the container 12. Each collection reservoir 16 is physically distinct and separate from the other collection reservoirs 16 and the number of collection reservoirs 16 is equal to the number of outlets 14. Each outlet 14 opens into a unique one of the collection reservoirs 16.

The container 12 holds a fluid 18 which comprises a colloidal suspension of magnetic submicron particles. A magnetic field gradient is established laterally through the fluid 18. The magnetic field gradient is a vector quantity illustrated by an arrow 20.

Those familiar with electromagnetic field theory will recognize that the magnetic field gradient vector 20 has lines of equal magnetic potential perpendicular to it. The magnetic potentials of adjacent liens vary according to the gradient. In the embodiment shown in FIG. 1, the equipotential lines extend generally vertically through the fluid 18 perpendicular to the arrow 20. The magnetic equipotential lines define regions of progressively diminishing magnetic flux density laterally across the container 12 from left to right.

The colloidal suspension of magnetic particles distributes spatially along the magnetic equipotential lines so that a magnetic susceptibility gradient is established laterally across the container 12 through the fluid 18. Illustratively, the left-most outlet 14 in FIG. 1 will open into the region of the highest magnetic susceptibility. The level of magnetic susceptibility than the outlets 14 open into progressively diminishes laterally across the container 12 so that the right-most outlet 14 opens into the region of the lowest level of magnetic susceptibility.

Particles 22 having different magnetic susceptibilities are introduced into the fluid 18 at the top of container 12. The particles 22 will begin to settle through the fluid 18 due to the force of gravity, and as they settle, they will spatially distribute through the fluid 18 along the magnetic susceptibility gradient. Eventually, when the particles 22 reach the outlets 14 at the bottom of container 12, they will have spatially distributed along the magnetic susceptibility gradient so that those of the particles 22 having substantially the same magnetic susceptibility will settle into the same collection reservoir 16 through the same outlet 14. A pump and valve arrangement 24 can be used to draw the collected particles 22 selectively from the individual collection reservoirs 16.

The method as just described with reference to the apparatus shown schematically in FIG. 1 can be practiced continuously. The particles 22 are continuously fed into the top of the containers 12. The reservoirs 16 are coupled to individual respective collection vessels (not shown) through the pump and valve arrangement 24. The collected particles 22 in the reservoirs 16 are selectively pumped out into their respective collection vessels by the pump and valve arrangement 24 on a periodic basis so that each reservoir is pumped out before it is completely filled with the collected, separated particles 22.

The magnetic field gradient can be obtained by using one or more magnetic wires in a magnetic field (as in high-gradient magnetic separation (HGMS)), the magnet of a Frantz separator, superconducting magnets such as are used in open-gradient magnetic separation, or other specially designed magnets.

Tests of this method were carried out using single-wire HGMS, two-wire HGMS, and a Frantz separator magnet. In a single-wire HGMS system, a ferromagnetic wire (parallel to the y-axis) in a magnetic field $H_o$ parallel to the x-axis produces a very high magnetic field gradient near the wire. The magnetic field is given as a function of the distance x from the wire axis by $$H_x = H_o\left(1 + \frac{M}{2H_o}\ \frac{a^2}{x^2}\right) \tag{11}$$

where M and a are the magnetization and the radius of the wire, respectively. From Equations (2) and (11), the distribution of colloidal particles is obtained as $$c = c_o \exp\left\{\frac{2\pi\mu_o(\chi_{fp} - \chi_{fs})d^3MH_o}{3kT}\left(\frac{1}{x_a^2} + \frac{M}{4H_o}\ \frac{1}{x_a^4}\right)\right\} \tag{12}$$

where $x_a$ is x/a.

Figure 2:
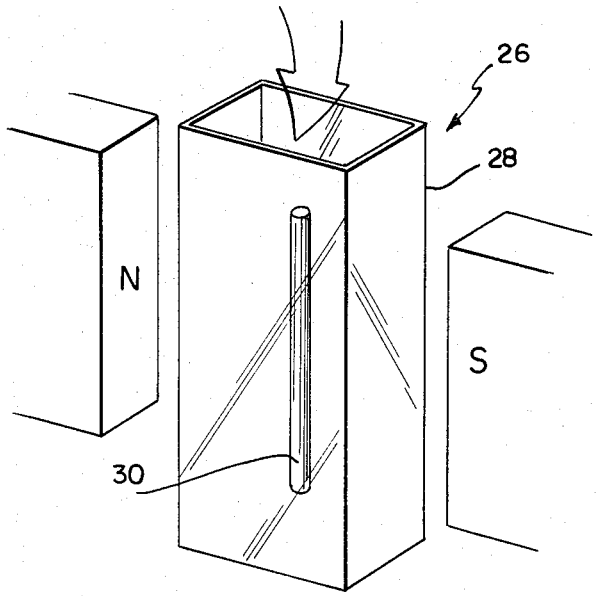
FIG. 2 is a perspective view of an experimental observation system utilized to observe the distibution of magnetic particles in a magnetic field.

The collection and particle distribution were observed by using a video camera and a recording system. Referring to FIG. 2, an experimental collection system included an observation chamber 26 made of a rectangular cross-section glass tube 28 having 0.1 mm by 1 mm inside dimensions. A nickel wire 30 having a 100 μm (0.1 mm) diameter is mounted at the center of the tube 28 in an axial configuration (that is, with the field oriented perpendicular to the wire 30 and the slurry flow parallel to the wire's axis).

The distribution of colloidal particle concentration was analyzed by digitizing the video image and processing the data through a computer system. The brightness of one pixel (one element of the video image) was coded to 255 levels. The concentration was obtained from the brightness by comparing the measured values with a calibrated reference, giving the concentration as a function of the brightness.

An aqueous suspension of submicron magnetic ($Fe_3O_4$) particles (diluted ferrofluid, such as Ferrofluid A-01 available from Ferrofluidics Corporation, 144 Middlesex Turnpike, Burlington, Mass. 01803) was used as a background fluid. The radii of these particles were measured by an electron microscope and found to be 71±12 Å. All experimental results were obtained at room temperature.

Figure 3:
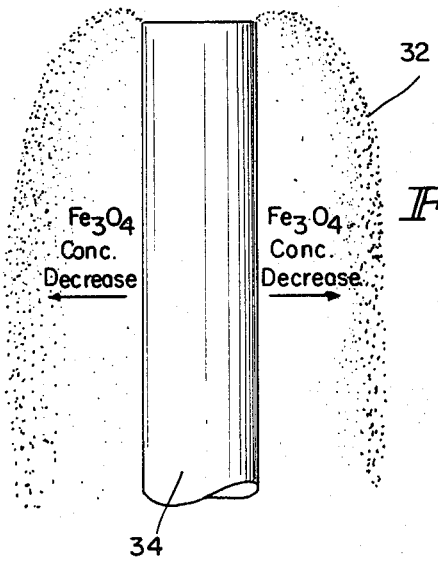
FIG. 3 illustrates results of an experiment to show the distribution of $Fe_3O_4$ particles about a nickel wire in a magnetic field.
Figure 4:
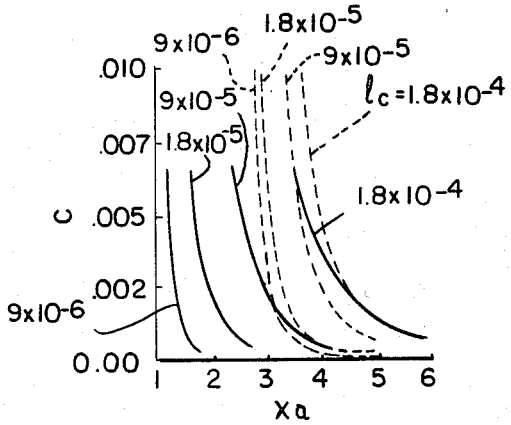
FIG. 4 is a graph illustrating the comparison between experimental and theoretical results of the distribution of an $Fe_3O_4$ colloid in a magnetic field of $H_o=4.0\times10^5$ A/m with varying initial concentrations.
Figure 5:
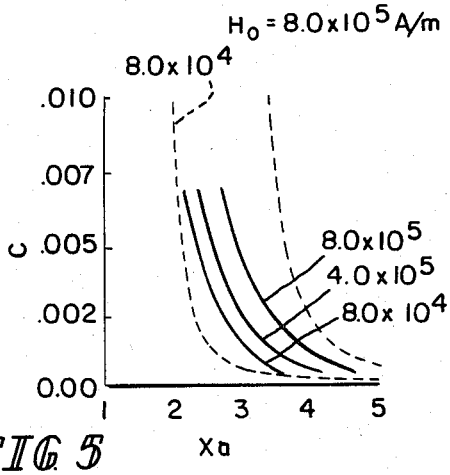
FIG. 5 is a graph illustrating the comparison between experimental and theoretical results of the distribution of an $Fe_3O_4$ colloid with initial concentrations of $9\times10^{-5}$ $cm^3/cm^3$ and varying magnetic field intensities.
Figure 6:
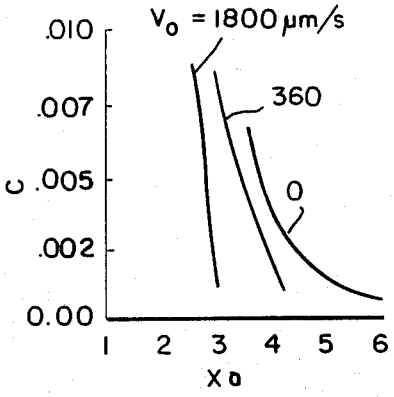
FIG. 6 is a graph illustrating the effect of flow on the concentration distribution.

Experimental results obtained using the collection system of FIG. 2 are shown in FIG. 3. FIG. 3 shows a typical buildup profile of $Fe_3O_4$ submicron particles 32 around a Ni wire 34 for a total collection time t of 60 minutes. The experimental results (solid lines) for the concentration distribution of $Fe_3O_4$ particles at the flow velocity $v_0=0$ for a total collection time t=60 minutes are given in FIGS. 4 and 5. The effects of varying the slurry concentration $c_o$ and varying the magnetic field $H_o$ are shown in FIGS. 4 and 5, respectively, together with the theoretical results for the steady state obtained from equation (12) (broken lines). In FIG. 4, the lines indicate the effect of changes in $c_o$ with $H_o$ held constant at $4.0\times10^5$ A/m. In FIG. 5, $c_o$ was held constant at $9\times10^{-5}$ and $H_o$ was varied. FIG. 6 indicates the effect of flow on the concentration distribution for various average flow velocities $v_o$ in the range from 0 to 1800 μm/sec at $H_o=4.0\times10^5$ A/m (5kOe). Almost no variation of the concentration was observed at 7 mm/sec.

Variation exists between experimental and theoretical results. The experimental measurements were performed in 60 minutes, so they were not obtained at steady state. Theoretical results are based on a one-dimensional model. Since $Fe_3O_4$ particles have a large magnetic moment, the effect of the collected particles on the subsequent collection may not be negligible. Specifically, the field distribution will be changed by the collection of strongly magnetic particles. Furthermore, the theoretical calculations were based upon a diffusion equation applicable to low concentration solutions. The experimental data were, at least to some extent, collected from high concentration regions of solutions.

Figure 7:
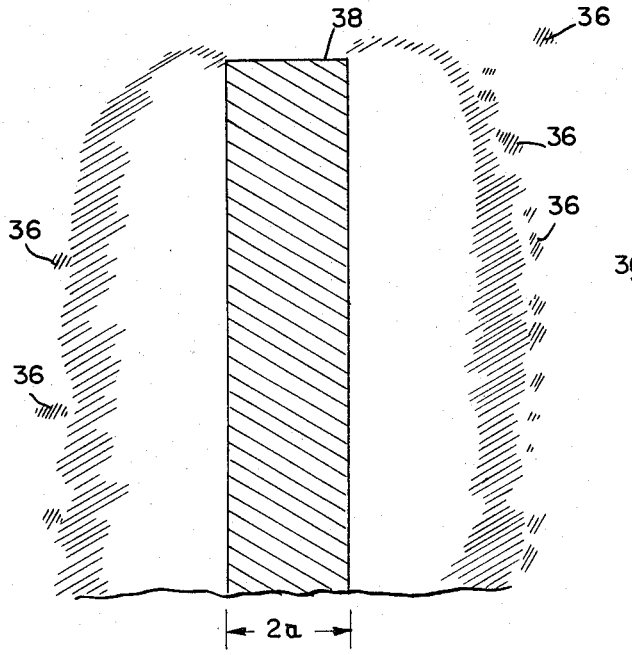
FIG. 7 illustrates results of an experiment to show the distribution of $Mn_2P_2O_7$ particles in a spatial distribution of colloidal $Fe_3O_4$ particles about a nickel wire in a magnetic field $H_o=1.6\times10^5$ A/m.
Figure 8:
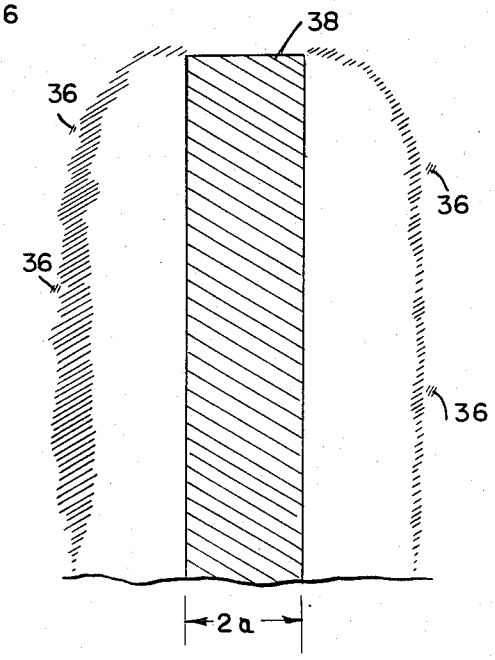
FIG. 8 illustrates results of an experiment to show the distribution of $Mn_2P_2O_7$ particles about a nickel wire in a magnetic field $H_o=4.0\times10^5$ A/m.

FIGS. 7 and 8 show the separation profiles of paramagnetic particles 36 ($Mn_2P_2O_7$) utilizing the apparatus of FIG. 2 with the magnetic field intensity $H_o$ equal to $1.6\times10^5$ A/m (2kOe) in FIG. 7 and $4.0\times10^5$ A/m (5kOe) in FIG. 8. As shown, the $Mn_2P_2O_7$ particles 36 separate out equidistantly along either side of the Ni wire 38.

Figure 9:
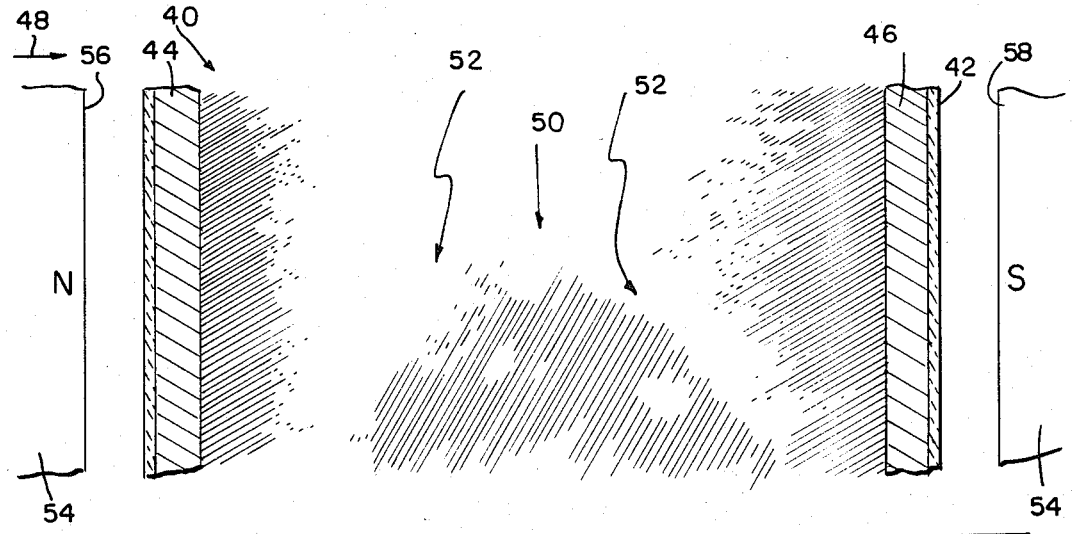
FIG. 9 illustrates results of an experiment to show the ability of a system constructed according to the present invention to separate $Al_2O_3$ and CuO.

Referring to FIG. 9, an experimental result of the separation of two different kinds of particles by a magnetic field gradient is shown. The separation system 40 has a container 42 with nickel wires 44, 46. The nickel wires 44, 46 are 500 μm in diameter and extend longitudinally along opposite sides of the container 42 parallel to each other. A $4.0\times10^5$ A/m (5kOe) magnetic field, generated by magnet 54 with north pole 56 and south pole 58, is applied generally perpendicular to the nickel wires 44, 46 as shown by arrow 48. The two nickel wires 44, 46 generate magnetic field gradients through the container.

A colloidal suspension of submicron $Fe_3O_4$ particles is held in the container 42. The two types of particles to be separated are diamagnetic particles 50 of $Al_2O_3$ ($\chi_p=-1.8\times10^{-5}$ (SI)) and weakly paramagnetic particles 52 of CuO ($\chi_p=2.4\times10^{-4}$ (SI)). The diamagnetic $Al_2O_3$ particles 50 tend to migrate toward a point generally equidistant from the two nickel wires 44, 46. That is, the diamagnetic particles of $Al_2O_3$ tend to collect where the susceptibility is lowest, halfway between the wires 44, 46. On the other hand, the weakly paramagnetic particles 52 of CuO tend to settle on both sides of the deposition 50 of $Al_2O_3$ particles, i.e., between the wires 44, 46 and the $Al_2O_3$ particle deposition 50.

The magnet of a Frantz separator produces a field gradient in the central plane of the air gap (in the x-direction), with an almost constant value of H dH/dx. A typical example of the magnetic field distribution is given by $$H = 2\times10^6\sqrt{X}\ (A/m) \tag{13}$$

The magnet of a Frantz separator could offer a linear relationship between the natural logarithm of concentration (as a function of distance), ln c, and distance x.

Figure 10:
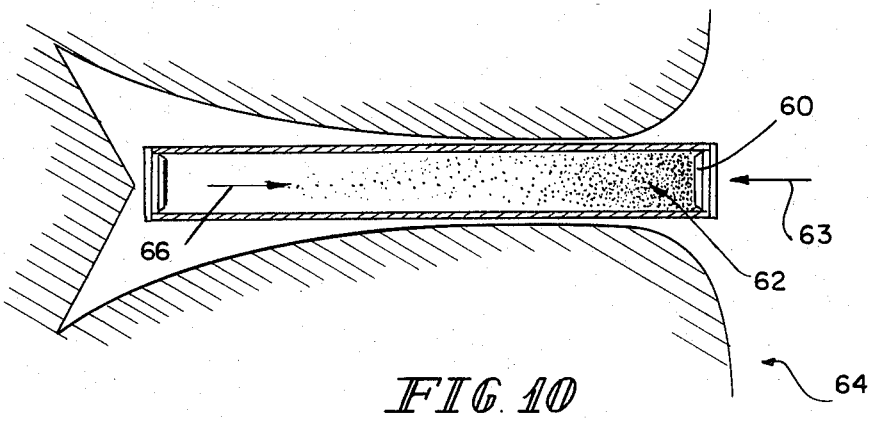
FIG. 10 illustrates an experiment to show the distribution of colloidal $Fe_3O_4$ particles in the gap of a magnet of a Frantz separator.

Referring to FIG. 10, a glass tube 60 having an inside diameter of 2.5 mm was filled with a 0.5% (vol/vol in water) $Fe_3O_4$ colloid 62 and placed in the gap 63 of a Frantz isodynamic separator magnet 64. The $Fe_3O_4$ particles 62 are distributed to form a concentration gradient with the concentration increasing as indicated generally by arrow 66.

Figure 11:
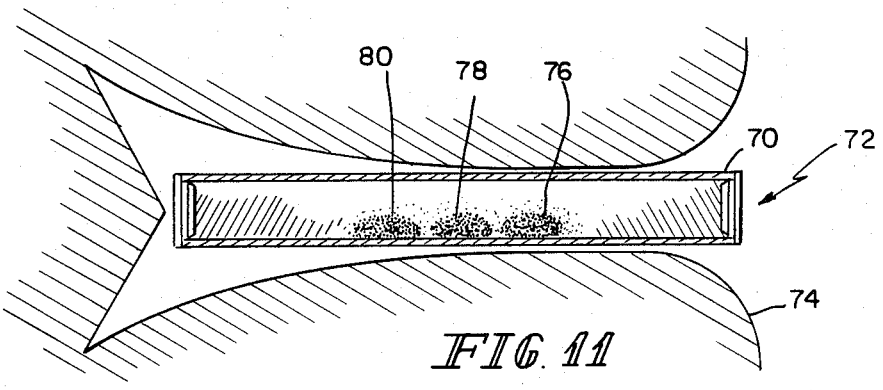
FIG. 11 illustrates an experiment conducted in the gap of a magnet of a Frantz separator to separate $Mn_2P_2O_7$, hornblende and $Al_2O_3$.

Referring to FIG. 11, a glass tube 70 having an inside diameter of 2.5 mm was filled with a 0.5% (vol/vol in water) $Fe_3O_4$ colloid and a mixture of $Mn_2P_2O_7$ ($\chi_p=4.7\times10^{-3}$ (SI)), hornblende ($\chi_p=2.3\times10^{-4}$ (SI)), and $Al_2O_3$ ($\chi_p=-1.8\times10^{-5}$ (SI)). The tube 70 was placed in the gap 72 of a Frantz isodynamic separator magnet 74 excited with a current of 0.5 A. After 5 hours, the mixture of particles separated as indicated by arrow 76 for the $Mn_2P_2O_7$ particles, arrow 78 for the hornblende particles, and arrow 80 for the $Al_2O_3$ particles.

Because of the thin (2.5 mm ID) glass tube 70 used for the experiment, it took about 5 hours to complete the separation. However, under more suitable conditions, after the establishment of the concentration distribution of the $Fe_3O_4$ colloidal fluid, the separation should take no longer than the settling time of the particles to be separated. As long as the net flow rate of the particles is kept at the order of 1 mm/sec or less in a HGMS system, depending on the range of concentration gradient required, the colloidal particle concentration gradient should not be affected during the course of the separation.

It is helpful to compare the present method to known prior art techniques such as magnetogravimetric (MGM) and magnetohydrostatic (MHS) separations. The principles of both MGM and MHS separation are the same. The difference between them is the use of ferrofluid in the former case, and a paramagnetic salt in the latter case. In these methods, particles suspended in a fluid are positioned at equilibrium between the force of gravity and a magnetic levitation force. The equilibrium state is given by $$\rho_p = \rho_f + \frac{\mu_o(\chi_p - \chi_f)}{2g}\ \frac{dH^2}{dx} \tag{14}$$

or $$\chi_p = \chi_f + \frac{2g(\rho_p - \rho_f)}{\mu_o\frac{dH^2}{dx}} \tag{15}$$

In these methods, the magnetic field gradient is not so large, with the result that the magnetic susceptibility $\chi_f$ of the fluid is almost at a constant value. $\rho_p$ and $\chi_p$ can be varied by almost a factor of ten. In the present inventive method, the susceptibility $\chi_f$ is varied by the diffusion of colloidal magnetic particles in a high magnetic field gradient. $\chi_f$ can vary over several orders of magnitude and can cover a range continuously from ferromagnetic to diamagnetic materials.

Figure 12:
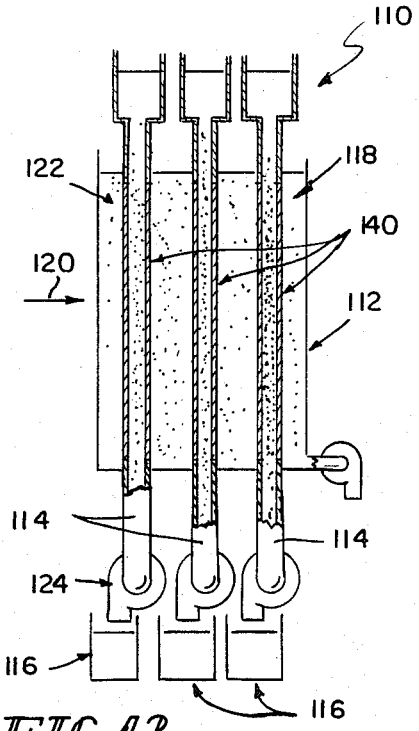
FIG. 12 illustrates an embodiment of a magnetic separator using the present invention with permeable membranes.

Turning now to FIG. 12, another embodiment of the invention is shown. A magnetic separation apparatus 110 has a container 112 holding a fluid 118. The fluid 118 comprises a colloidal suspension of submicron magnetic particles.

Multiple (tubular-shaped) permeable membranes 140 are provided. Each membrane 140 surrounds a magnetic equipotential line. The lower end of each membrane 140 supplies one of the outlets 114 and extends up into a collection reservoir 116. A magnetic field gradient is established in the direction of arrow 120. Particles 122 having differing magnetic susceptibilities are introduced into the container 112. The magnetic field gradient causes the colloidally suspended particles to distribute spatially as described in FIG. 1. The particles 122 are separated according to their relative magnetic susceptibilities as discussed in FIG. 1. The membranes 140 enclose volumes of generally different magnetic susceptibilities. The particles, having an equilibrium position given by Equation (10), between membranes are collected by using a pump and valve arrangement 124. Each collection volume enclosed by permeable membranes 140 can be controlled independently.

Each permeable membrane 140 has a pore size which is selected to permit the migration of the particles desired to be collected into the enclosed volume. Another advantage of the use of the membrane is to block particles larger than the pore size from entering the enclosed volume, thereby permitting a more uniform mono-fraction to be collected in the enclosed volume.

The establishment of the equilibrium distribution of colloidal particles in a magnetic field gradient typically requires an extended period of time. Since the colloidal solution is drawn off with the separated particles as they are collected, the colloidal solution must be replenished continuously. Therefore, a technique for providing the colloidal solution with a concentration distribution efficiently will increase the efficiency of an apparatus or system made in accordance with the instant invention.

Figure 13:
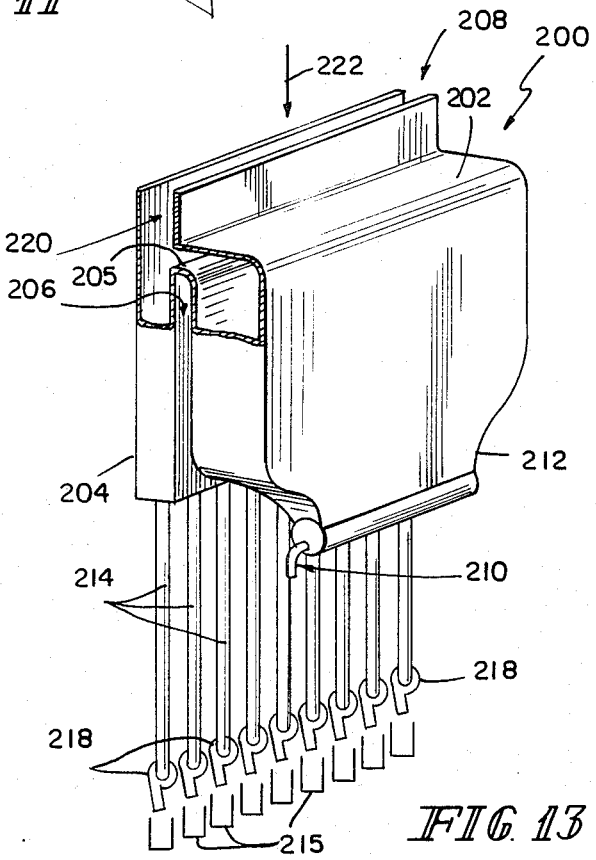
FIG. 13 illustrates a method for efficiently providing a colloidal solution with a concentration distribution.

Referring to FIG. 13, a system for efficiently providing a colloidal solution with a concentration distribution is shown in somewhat diagrammatic perspective, with the near walls of the apparatus partly broken away for purposes of clarity. The system 200 includes a reservoir 202 in which a concentration distribution is established and a particle separation reservoir 204. The reservoirs 202, 204 are connected together by a passageway 205, the lower wall of which forms a common edge, barrier, or threshold 206. Reservoir 204 is provided with a particle inlet 208.

Reservoir 202 has an inlet 210 for colloidal solution generally at the lowest part 212 of reservoir 202. Reservoir 204 has a number of outlets 214 connected to reservoir 204 across the bottom of reservoir 204. Each outlet 214 is coupled to a respective collection pump 218, in order to draw off the collected particles from the respective collection reservoir 215.

In operation, reservoirs 202, 204 are both initially filled with the colloidal solution to slightly above the level of barrier 206. A magnetic field gradient is established as discussed previously in the direction indicated by arrow 220. After an appropriate period of time, a concentration distribution will have been established in the colloidal solution. This concentration distribution of the colloidal solution establishes the magnetic susceptibility gradient. Once this concentration distribution is established, the particles to be separated are introduced into particle inlet 208 of reservoir 204 generally as indicated by arrow 222.

The particles 222 will begin to travel throughout reservoir 204 and migrate toward different portions of reservoir 204 having magnetic susceptibilities substantially equal to the different magnetic susceptibilities of the particles. After a suitable time, the particles 222 will have separated according to their magnetic susceptibilities, and will be collected through outlets 214 into associated respective collection reservoirs 215 by using pumps 218. Each collection reservoir 215 will therefore contain a fraction of the colloidal solution and separated particles from particles 222 having substantially the same magnetic susceptibility.

Since the colloidal solution is drawn off along with the separated particles, it is necessary to replenish the colloidal solution continuously. The colloidal solution in reservoir 204 is continuously replenished by the colloidal solution from reservoir 202 which trickles over the barrier 206 from reservoir 202 into reservoir 204. The colloidal solution in reservoir 202 is driven with essentially no turbulence over the barrier 206 by introducing colloidal suspension into reservoir 202 through the colloidal solution inlet 210 at the bottom of reservoir 202. By introducing the colloidal solution at the bottom of reservoir 202, the colloidal solution which trickles into reservoir 204 over barrier 206 has its concentration distribution, which has been established during its residence in reservoir 202, essentially undisturbed as it flows over barrier 206.

As the colloidal solution is driven from the bottom of reservoir 202 toward the top by the continuous introduction of more colloidal solution at inlet 210, the concentration distribution which is desired in reservoir 204 begins to form under the influence of the field gradient 220, to which the contents of both reservoirs 202, 204 are exposed. As the solution reaches the level of the barrier 206, the desired concentration distribution has formed. This concentration distribution remains essentially undisturbed as the colloidal solution trickles over the barrier 206. The subsequent introduction of particles 222 into the concentration-distributed colloidal solution in reservoir 204 is accomplished in such a manner as not to disturb the concentration distribution thus achieved. The rate at which the colloidal solution is introduced at inlet 210 must be the rate at which the colloidal solution is trickling over barrier 206. The rate at which colloidal solution and particles are introduced into reservoir 204 must be the rate at which colloidal solution and particles are withdrawn from reservoir 204 through outlets 214, collection reservoirs 215, and pumps 218.

What is claimed is:

1. In a fluid comprising a colloidal suspension of first magnetic particles, a method of magnetically separating second particles, the second particles comprising a plurality of particle fractions having different magnetic susceptibilites, the method comprising the steps of introducing the second particles into the fluid, and establishing a magnetic susceptibility gradient through the fluid by establishing a magnetic field gradient through the fluid to cause the colloidally suspended first particles to form the magnetic susceptibility gradient through the fluid to cause the second particles to separate generally along the magnetic susceptibility gradient according to their respective magnetic susceptibilities.

2. The method of claim 1 wherein the colloidally suspended first particles are submicron particles.

3. The method of claim 1 further comprising the step of separating regions of differing magnetic susceptibilities along the magnetic field gradient with a permeable membrane having a pore size selected to permit the migration of a certain size fraction of the second particles through the membrane into a volume enclosed by the membrane and withdrawing said certain size fraction with generally the same magnetic susceptibility from the volume.

4. The method of claim 1 wherein the step of establishing a magnetic susceptibility gradient through the fluid comprises the step of using a single conductor high gradient magnetic separator.

5. The method of claim 1 wherein the step of establishing a magnetic susceptibility gradient through the fluid comprises the step of using a Frantz separator magnet.

6. The method of claim 1 wherein the step of establishing a magnetic susceptibility gradient through the fluid comprises the step of using a superconducting magnet.

7. The method of claim 1 wherein the step of establishing the magnetic susceptibility gradient within the first fluid comprises the steps of establishing the magnetic susceptibility gradient within the first fluid while the first fluid is contained within a first container, feeding the first fluid from the first container into a second container in such a manner as to maintain the susceptibility gradient of the first fluid as it is fed from the first container into the second container and the step of introducing the second particles comprises introducing the second particles into the second container, the second container including means defining outlets disposed across the bottom of the second container in the direction of the magnetic susceptibility gradient, and withdrawing the separated second particle fractions according to their magnetic susceptibilities through respective ones of the outlets.

8. The method of claim 7 and further comprising continuously replenishing the first fluid in the first container in such a manner as to prevent the disturbance of the magnetic suspectibility gradient of the first fluid feeding into the second container.

9. The method of claim 1 wherein the step of establishing the magnetic susceptibility gradient comprises establishing the magnetic susceptibility gradient across a container of said fluid, the method further comprising the steps of feeding the second particles into the container, providing a plurality of collection reservoirs spaced across the container in the direction of the magnetic field gradient, each reservoir having an inlet opening along the magnetic susceptibility gradient so that each inlet couples its reservoir to a region of magnetic susceptibility different from those of adjacent inlets, the second particles migrating toward equilibrium along the magnetic susceptibility gradient according to the respective magnetic susceptibilities of the second particles so that each of the reservoirs collects those of the second particles having generally the same magnetic susceptibilities, and withdrawing the collected second particles from the reservoirs.

10. The method of claim 9 wherein the reservoirs comprise permeable membranes selected to permit the migration of the desired second particles through the membranes into the reservoirs.

11. The method of claim 9 and further comprising the step of continuously separating the second particles by continuously feeding the second particles into the container and continuously withdrawing the collected second particles from the respective reservoirs into separate containers.

12. The method of claim 9 wherein the step of establishing the magnetic field gradient within the first fluid comprises establishing the magnetic field gradient within said first-mentioned container and within a second container, both of the first-mentioned and second containers containing colloidal suspension, the step of establishing the magnetic susceptibility gradient within the first fluid comprises replenishing the first fluid in the second container as the first fluid is removed from the first container by the collection of fluid into the collection reservoirs and permitting the first fluid to flow from the second container into the first container so as to maintain the magnetic susceptibility gradient which is established within the first fluid in the second container.

13. A method for magnetically separating particles having different magnetic susceptibilities comprising the steps of introducing into a container of a fluid comprising a colloidal suspension of first magnetic particles, second particles comprising a plurality of particle fractions having different magnetic susceptibilities, with the second particles to be separated according to their different magnetic susceptibilities, establishing a magnetic field gradient across the container to cause a spatial distribution of the colloidally suspended first particles to form a magnetic susceptibility gradient across the container to cause a spatial distribution of the second particles related to the respective magnetic susceptibilities of the individual second particle fractions, the container including means defining outlets disposed across the bottom of the container in the direction of the magnetic susceptibility gradient, and withdrawing the spatially distributed second particle fractions through respective ones of the outlets.

14. The method of claim 13 and further comprising the steps of continuously introducing the second particles into the container and continuously withdrawing the spatially separated second particle fractions.

* * * * *